United States Patent [19]

Smith

[11] Patent Number: 4,997,415

[45] Date of Patent: Mar. 5, 1991

[54] CONTINUOUS ROD-MAKING MACHINE

[75] Inventor: Michael N. Smith, High Wycombe, England

[73] Assignee: Molins Machine Co. Inc., Richmond, Va.

[21] Appl. No.: 489,737

[22] Filed: Feb. 28, 1990

Related U.S. Application Data

[63] Continuation of Ser. No. 7,108,008, Oct. 14, 1987, abandoned.

[30] Foreign Application Priority Data

Oct. 15, 1986 [GB] United Kingdom ..... 8624713

[51] Int. Cl.[5] ..... A24B 7/14; A24C 5/28

[52] U.S. Cl. ..... 493/45; 83/356; 83/310; 83/258; 83/259; 131/65; 384/473; 384/474

[58] Field of Search ..... 493/45; 131/65; 83/258, 83/259, 310, 355, 356; 384/473, 474

[56] References Cited

U.S. PATENT DOCUMENTS 1,736,966 11/1929 Delaval-Crow ..... 384/473
2,711,764 6/1955 Slysh ..... 131/65
3,476,002 11/1969 Bardenhagen et al. ..... 83/355
3,730,034 5/1973 Preston ..... 83/310
3,830,126 8/1974 Ringe ..... 83/310

FOREIGN PATENT DOCUMENTS 1556267 11/1979 United Kingdom ..... 131/65

*Primary Examiner*—Frederick R. Schmidt
*Assistant Examiner*—Jack Lavinder
*Attorney, Agent, or Firm*—Antonelli, Terry, Stout & Kraus

[57] ABSTRACT

A ledger assembly for a continuous rod cut-off includes a rigid beam (12) carrying ledger tubes (10) and pivotally supported by fibreglass springs (16,22). Vertical springs (22) resist the cutting force of the cut-off knife (30) and allow reciprocal movement of the tubes (10) while imparting a vertical displacement to the beam (12) so that the tubes follow a straight path along the rod line (28). A horizontal spring (16) allows this vertical displacement while providing lateral stiffness for the base of the beam (12). A drive arrangement for the beam (12) includes a lubricating system for a bearing (42) of a connecting rod (36) in which lubricant is collected for return by action of centrifugal force in a housing (72) located on the side of the bearing opposite a lubricant supply path (86, 88) through a crankshaft (40).

26 Claims, 6 Drawing Sheets

CONTINUOUS ROD-MAKING MACHINE

This application is a continuation of application Ser. No. 108,008, filed Oct. 14, 1987 now abandoned.

This invention relates to continuous rod-making machines, particularly for use in the production of cigarettes and cigarette filter rods.

According to a first aspect of the invention a machine for producing rod-like articles includes a continuous rod cut-off device and a ledger assembly, said assembly comprising means for supporting a rod during cutting, a substantially rigid beam carrying the supporting means, drive means for reciprocating the beam, and resilient means supporting the beam, said resilient means comprising first means allowing movement of at least that part of the beam carrying the supporting means in a direction generally parallel to the rod and second means allowing movement of said part in a direction generally transverse to said rod. Preferably said first and second means are arranged so that during reciprocation caused by said drive means said supporting means moves substantially parallel to the rod. The first and/or second means may be arranged to allow reciprocal movement, which may be pivotal.

In a preferred arrangement the first means comprises means, e.g. one or more leaf springs, extending parallel to a longitudinal axis of the beam, and the second means comprises means, e.g. one or more similar springs, extending in a direction transverse to said axis. The leaf springs are preferably constructed of fibreglass. The beam is preferably arranged so that the rod supporting means is at or near an upper end of the beam and the beam is effectively pivoted about its lower end. The beam may be moved so that its lower end is constrained in a direction parallel to movement of the rod by said second means. The first means may extend between an upper stationary mounting position and a lower position on the beam; this arrangement causes the beam to be lifted during reciprocal movement and such lifting (which is allowed by the second means) can be arranged to compensate for downward movement of the supporting means caused by pivotal movement of the beam, thereby achieving the preferred movement of the supporting means in a direction parallel to the rod. It will be noted that when the beam is pivotally mounted supporting means in the form of tubes for supporting a rod during cutting will pivot about a transverse axis during reciprocation even when any movement transverse to the rod is compensated for as described above. Therefore, any such tubes or other supporting means which closely surround a rod should be arranged to have sufficient clearance to allow this pivotal movement (which may be of the order of $+$or $-4°$). In order to facilitate initial entry of a rod the upstream portion of the supporting means may comprise a flared lead-in for the rod.

According to a second aspect of the invention a machine for producing rod-like articles includes a continuous rod cut-off device and a ledger assembly, said assembly comprising means for supporting a rod during cutting, a substantially rigid beam carrying the supporting means, drive means for reciprocating the beam, first mounting means allowing movement of the beam so that the rod supporting means is movable in a direction parallel to the rod, and second mounting means allowing movement of the beam so that the rod supporting means is movable in a direction transverse to the rod, whereby said rod supporting means is constrained to follow a substantially straight path at least partially surrounding the rod during reciprocation by said drive means. Preferably said first mounting means comprises pivotal means, and said first and second mounting means may be arranged so that a pivotal axis of the beam is moved in a direction transverse to the rod during said reciprocation. In this way a path of said rod supporting means which would be arcuate due to pivoting about an axis of the beam may be converted into a straight path by appropriate compensatory movement of said axis during pivoting.

According to a third aspect of the invention a machine for producing rod-like articles includes a continuous rod cut-off device and a ledger assembly, said assembly comprising means for supporting a rod during cutting, and drive means for moving said supporting means, said drive means including a bearing, means defining a supply path for lubricant under pressure to said bearing and means defining a return path for lubricant, said return path defining means including a housing for receiving lubricant which has passed through the bearing and collection means which is movable relative to lubricant in the housing so that said lubricant is urged along a further portion of said return path connected to said collection means. Preferably said housing is rotatable with a movable part of said bearing and said collection means is stationary. Thus the housing may comprise a generally cylindrical chamber and the collection means may comprise a tube or scoop having an entrance portion adjacent the internal periphery of the chamber, so that lubricant moved to the periphery of the chamber by action of centrifugal force is collected by said tube or scoop and the pressure generated thereby is sufficient to move lubricant onwards along said return path.

Preferably the supply path and the return path are on opposite sides of the bearing. The housing or chamber may be at least partly supported for rotation by further bearings carried by the collection means or means defining the return path connected to the collection means.

The bearing is particularly usefully employed as the big end bearing of a connecting rod extending between a driven crankshaft and said supporting means. It has been found that previous arrangements for lubricating this bearing are not satisfactory at the higher speeds and loads now envisaged for continuous rod-making machines. In particular, grease-lubricated bearings generally run hot, with resultant need for frequent re-application of grease. Similarly, systems for recirculating a flowable lubricant such as oil into a bearing from a main driveshaft and returning it into the driveshaft under pressure cause substantial turbulence of the oil in the bearing, which again causes the bearing to run very hot. The presently proposed arrangement allows a lubricant to be fed through the bearing at relatively low pressure since the action of centrifugal force in the collection chamber or housing generates its own pressure for moving the lubricant along the return path. Although in the preferred arrangement it is necessary to provide additional parts on the side of the bearing opposite to that of the main drive, such parts can be balanced about the axis of the driveshaft so that no additional load is experienced during constant speed rotation of the driveshaft.

The first and second and third aspects of the present invention may be incorporated in the same machine.

In principle the bearing of the present invention is usable in machines other than continuous rod-making machines.

The invention will be further described, by way of example only, with reference to the accompanying diagrammatic drawings, in which.

Figure 1:
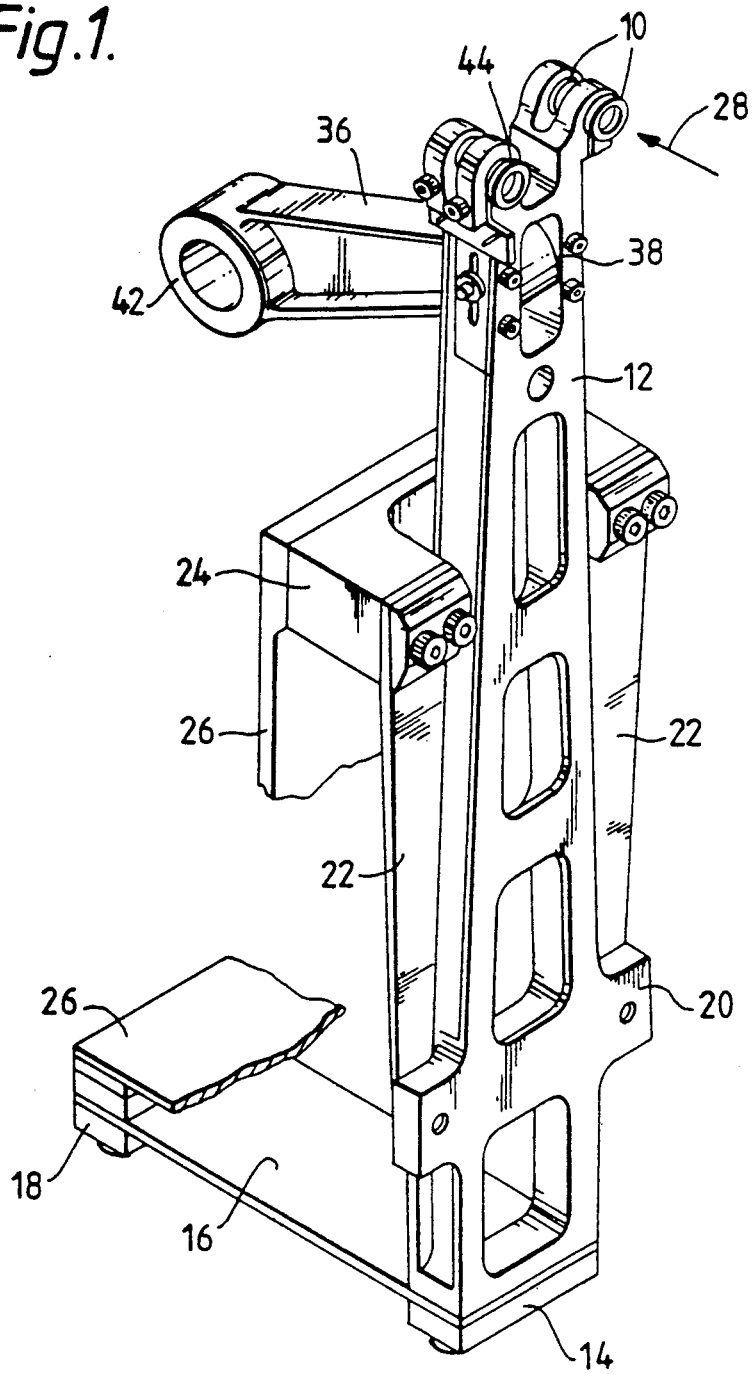
FIG. 1 is a perspective view of a ledger assembly.

Referring to FIGS. 1 to 4, a ledger, comprising a pair of rod support tubes 10, is carried at the upper end of a rigid beam 12. The beam 12 is made of aluminium alloy or other lightweight strong material and is of such mechanical construction that it has high resistance to bending in planes containing its longitudinal axis and also high resistance to twisting about said axis. The beam 12 has a lower mounting 14, at which it is connected by a horizontal fibreglass spring 16 to a stationary support mounting 18, and an upper mounting 20, at which it is connected by a pair of vertical fibreglass springs 22 to another stationary support mounting 24.

The support mountings 18 and 24 form part of the frame 26 of a rod-making machine and serve to hold the beam 12 so that the rod support tubes 10 lie on the rod line 28 of the machine. The location of the tubes 10 is also such that a rod cut-off knife 30 (FIG. 2) carried by a rotary cut-off drum 32 passes between the tubes 10. A de-burring wheel 34 is provided for the knife 30.

Adjacent its upper end the beam 12 is connected to one end of a connecting rod 36 by a little end bearing 38. At its other end the connecting rod 36 is connected to a cranked drive member 40 (FIG. 3) by a big end bearing 42. The drive member 40 and the cut-off drum 32 are driven in synchronism by a motor of the rod-making machine.

In order that the beam 12 is symmetrical (and therefore balanced) about a central longitudinal axis a pair of dummy tubes 44 is carried at the upper end of the beam on the opposite side of the connecting rod bearing 38 to the support tubes 10.

The connecting rod 36 is driven by the drive member 40 so that the upper end of the beam 12 carrying the rod support tubes 10 is reciprocated on the rod line 28 and so that the rod is supported during passage of the cut-off knife 30 between the tubes to cut the rod. During angular displacement of the beam 12 by the connecting rod 36 the horizontal spring 16 holds the base of the beam substantially in the same vertical plane, so that in effect the beam pivots about its lower mounting 14. The vertical springs 22 are deflected during displacement of the beam 12 from a vertical position. This deflection can be regarded as pivotal about the stationary mounting 24 but it also includes bending of the springs 22. The combined effect is to lift slightly the mounting 20 and with it the whole beam 12. The horizontal spring 16 deflects slightly upwards to allow this lifting.

By virtue of its effective pivoting about an imaginary axis of its lower mounting 14, angular displacement of the beam 12 would cause the rod support tubes 10 to follow a path which moves downwards on each side of the vertical position of the beam if the vertical position of the mounting 14 remained fixed. However, since the above-mentioned movement of the springs 22 causes the beam 12 to be lifted and the horizontal spring 16 allows this, the downward movement of the tubes 10 is less than would otherwise be the case. The dimensions of the beam 12 and the springs 22 (and to a lesser extent the bending properties of the springs 22) are arranged such that the beam 12 is lifted during deflection such that the lifting of the beam is sufficient to compensate for the downward movement of the tubes 10 at least in the range of angular displacement generated by the connecting rod 36, so that the tubes 10 follow a substantially linear path parallel to the rod line 28. Note that the tubes 10 still tilt slightly as a result of the angular displacement of the beam 12, and sufficient clearance must be allowed for passage of a rod on the rod line 28 through the tubes during maximum tilting occuring at maximum angular displacement of the beam. In addition, in order particularly to facilitate initial passage of a rod through the tubes 10 when the beam 12 may be angularly displaced, the latter may be formed with flared lead-in and lead-out portions, as shown in greater detail in FIG. 4.

Figure 4:
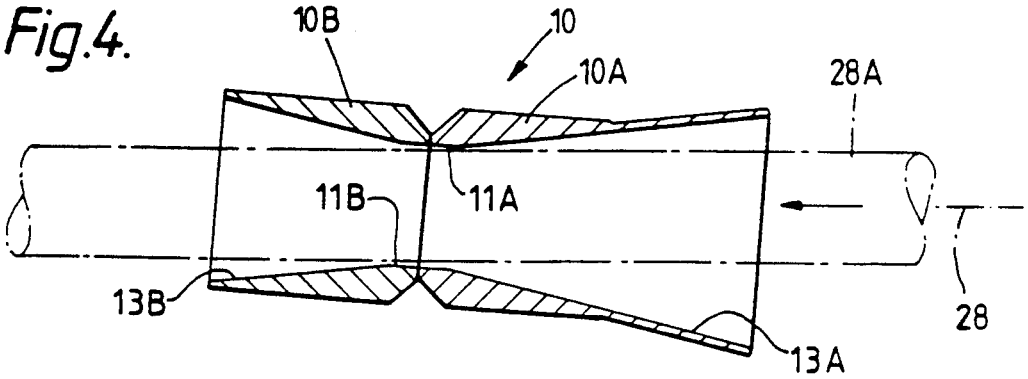
FIG. 4 is an enlarged detail view of part of the assembly of FIG. 1.

FIG. 4 shows a ledger tube 10 at its maximum upstream displacement relative to the direction of movement of a rod 28A on the rod line 28. The tube 10 comprises upstream and downstream portions 10A, 10B separated by a gap of just sufficient width to allow passage of the cut-off knife 30. In use, the knife 30 normally contacts and is supported during cutting by the face of the downstream portion 10B. The portions 10A, 10B each have relatively short cylindrical internal boxes 11A, 11B and flared lead-in and lead-out portions 13A, 13B respectively. The lead-in portion 13A is rather longer than the lead-out portion 13B. Both portions 13A, 13B are angled sufficiently to allow clearance for the rod 28A at maximum displacement of the tube 10.

The vertical springs 22 provide lateral stiffness to resist the cutting force transferred to the beam 12 during passage of the cutoff knife 30 through a rod. The horizontal spring 16 provides lateral stiffness for the base of the beam, resisting particularly any tendency of the beam to twist about a vertical axis.

Figure 2:
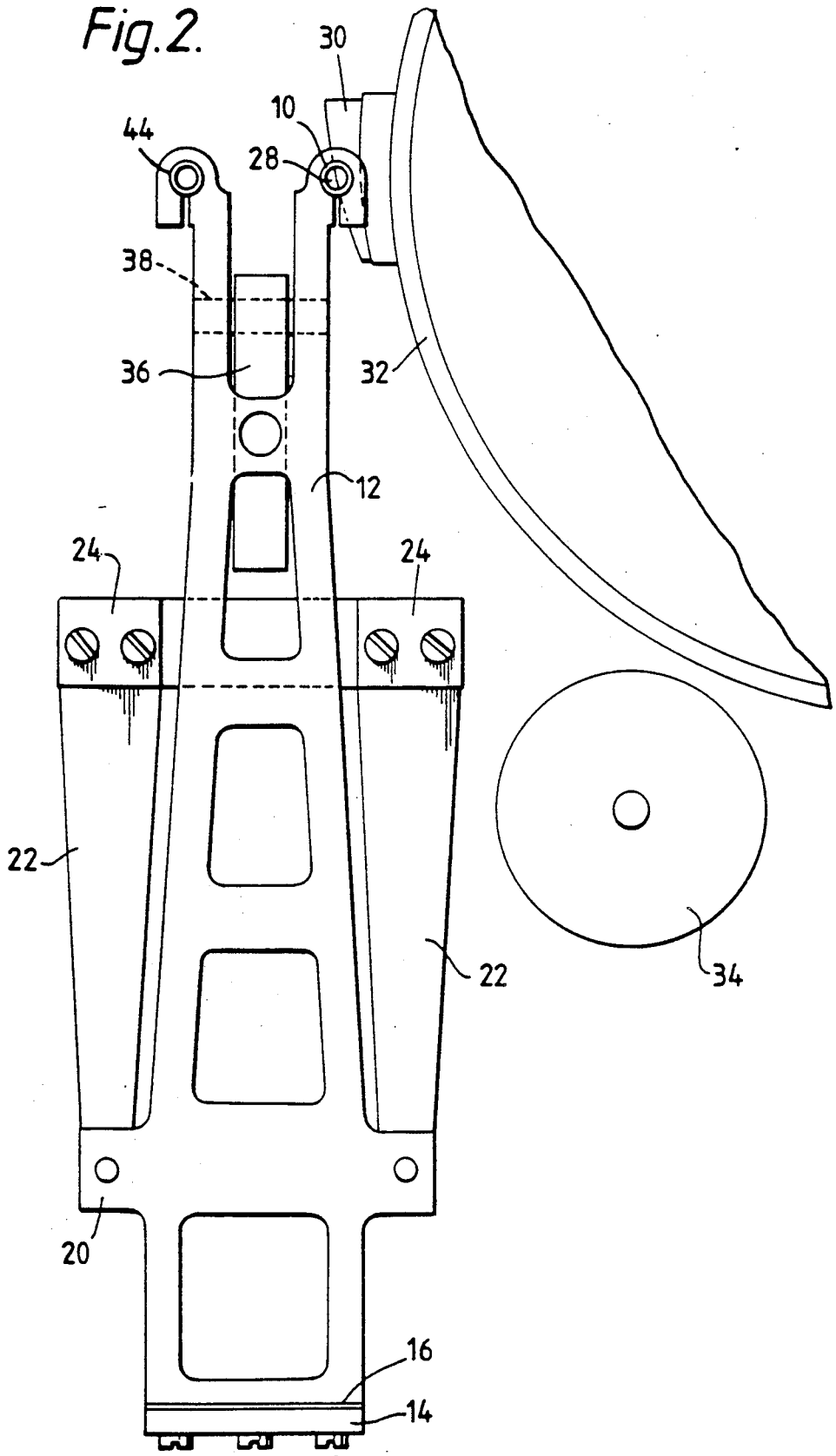
FIG. 2 is an end view of the assembly of FIG. 1.
Figure 3:
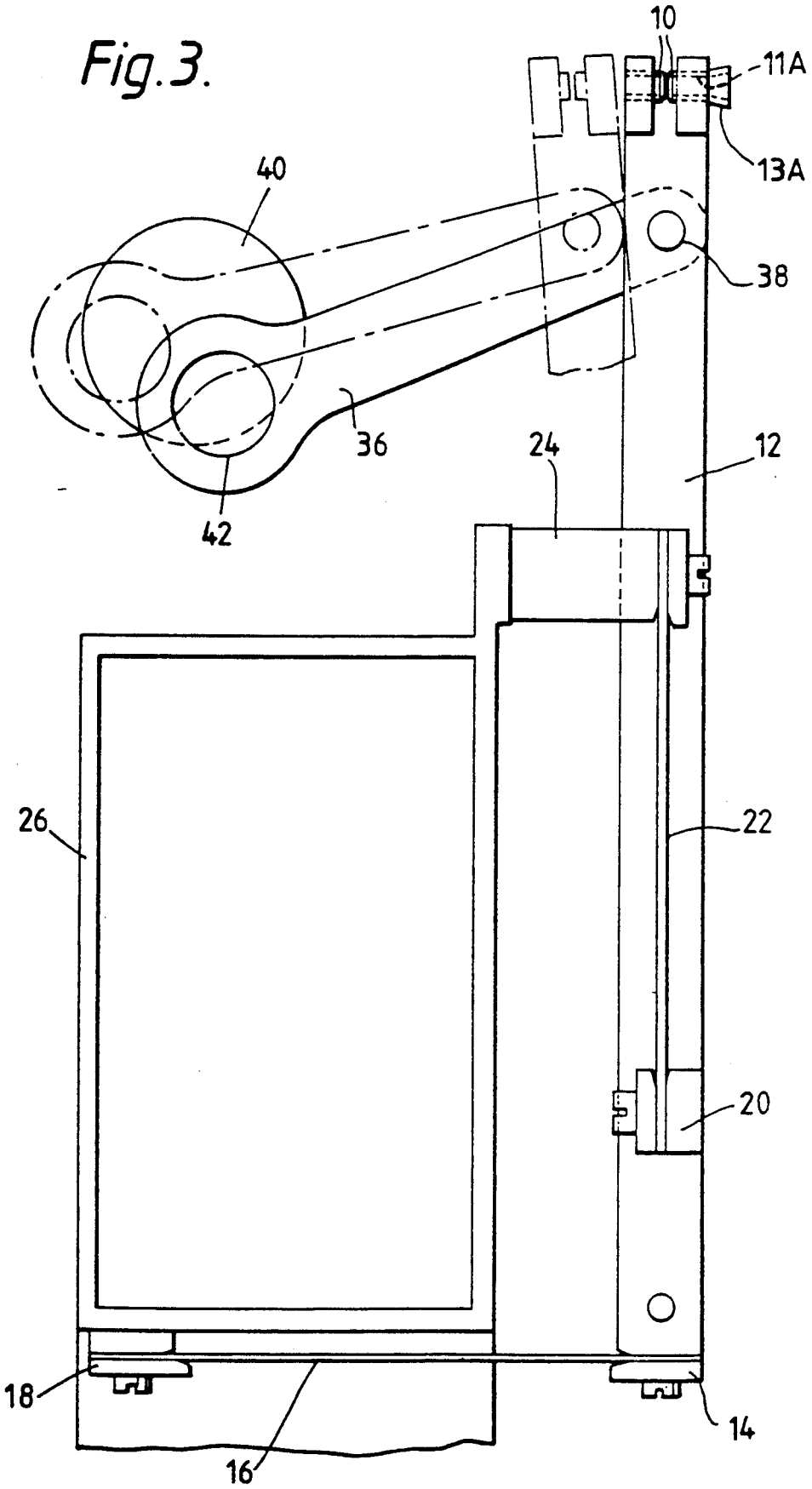
FIG. 3 is a side view of the assembly of FIG. 1.

The vertical springs 22 are tapered in a direction from the stationary mounting 24 to the mounting 20. This allows the mounting 20 on the beam 12 to be smaller, and therefore lighter, while retaining suitable properties of bending and lateral strength in the springs 22. The horizontal spring 16 could also be tapered in a direction from the mounting 18 to the mounting 14. However, adequate strength can be obtained in a spring 16 having a constant width which is no greater than that of the base of the beam 12 and no significant benefit is achieved by having the spring 16 and mounting 14 less wide than the base of the beam 12; on the contrary, there would be a disadvantage of reduced lateral stiffness. The springs 22 are symmetrical about a central longitudinal axis, to reduce the possibility of imposing any twisting force on the beam 12 about its longitudinal axis. For a similar reason the springs 22 are aligned with a central plane of the beam 12 (as shown in FIG. 2); however the springs could be offset from this plane and this could allow the mounting 20 to be of lighter construction.

The springs 16 and 22 are preferably constructed of a fibreglass material. A suitable material is available from Heathcote Plastics of Newcastle-under-Lyme, Staffs. and is identified as Scotchply Reinforced Plastic type 1002 crossply (13 ply).

Typical main dimensions of the assembly of FIGS. 1 to 4 are as follows:

Length of beam 12: 160mm
Width of beam (at base): 80mm
Width of beam (adjacent connecting rod 36): 45mm
Length of springs 22 (between mountings): 160mm
Width of springs 22: 20–38mm
Length of spring 16 (between mountings): 160mm
Width of spring 16: 80mm
Thickness of springs 16, 22: 3.2mm
Deflection of ledger tubes 10: +or −32mm (+or −4°)
Deflection of springs 22: +or −6mm
Deflection of springs 16: 0–1mm
Length of connecting rod 36: 168mm.

Figure 5:
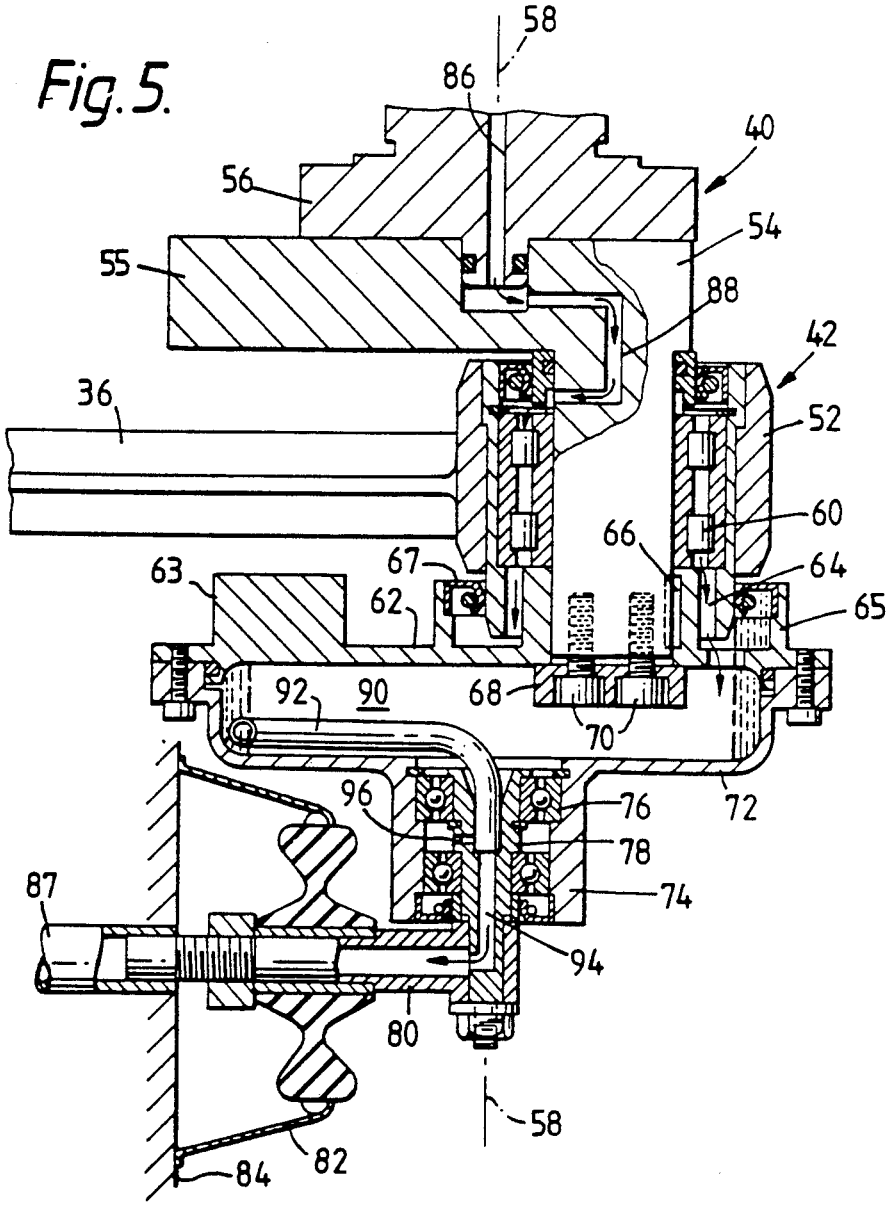
FIG. 5 is a sectional view of a bearing assembly suitable for use with the ledger assembly of FIG. 1.
Figure 6:
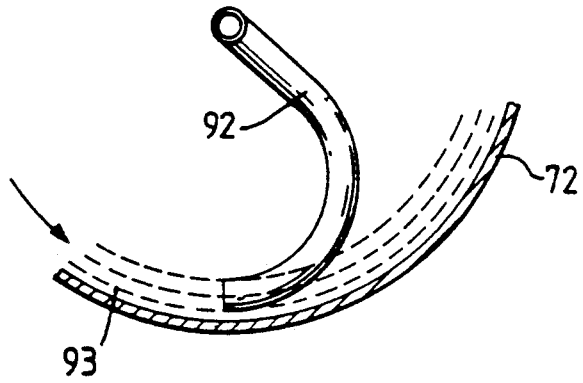
FIG. 6 is a detail view of part of the bearing assembly of FIG. 5.

FIGS. 5 and 6 show part of a drive member 40 incorporating a bearing assembly including a bearing suitable for use as the big end bearing 42 of the connecting rod 36 of the ledger assembly of FIGS. 1–4. The bearing 42 comprises a bearing shell 52 carried by a crankshaft 54 drivingly connected to a driveshaft56 having an axis 58. The shell is carried on the crankshaft 54 by a roller bearing assembly 60. The end of the crankshaft 54 remote from the driveshaft 56 carries a generally circular baseplate 62 having a non-central sleeve portion 64 which is keyed and clamped to the crankshaft by means of key 66 and clamping plate 68 and bolts 70. A domed cover 72 is connected to the baseplate 62 and has an axially central integral sleeve portion 74 containing a bearing 76 rotatably supported on a hollow stub-shaft 78. The axis of the stub-shaft 78 lies on the axis 58 of the driveshaft 56. A pipe assembly 80 is connected at right angles to the end of the stub-shaft 78 and is supported by a flexible mounting 82 carried on a stationary surface 84 of the rod-making machine. The pipe assembly 80 is connected to a further pipe assembly 87 leading to an oil sump (not shown) in the machine.

The baseplate 62 carries a counterweight 63 to balance about the axis 58 those additional parts which are connected to the crankshaft 54 and which are not symmetrical about the axis. These parts comprise mainly the plate 68 and bolts 70, and an annular sleeve portion 65 of the baseplate 62 which carries an oil seal 67 surrounding the end of the crankshaft 54. The crankshaft 54 has its own integral balancing weight 55.

In use, oil is pumped from the sump into a passageway 86 in the driveshaft 56 and passes through a passageway 88 in the crankshaft 54 to lubricate the bearings 60. Excess oil 93 (FIG. 6) passes into the chamber 90 and subsequently into the collector tube 92 due to centrifugal force. Oil collected by the tube 92 passes through a passageway 94 in the stub-shaft 78 and returns to the sump by way of the pipe assemblies 80 and 84. The bearings 76 are lubricated in part by a bleed passage 96 extending from the passageway 94.

Figure 8:
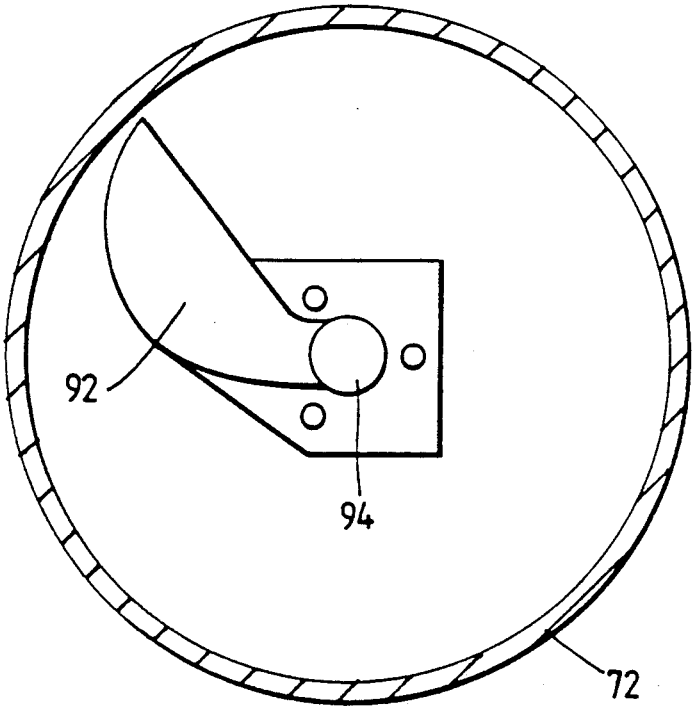
FIG. 8 is a detail view of part of the bearing assembly of FIG. 7.
Figure 7:
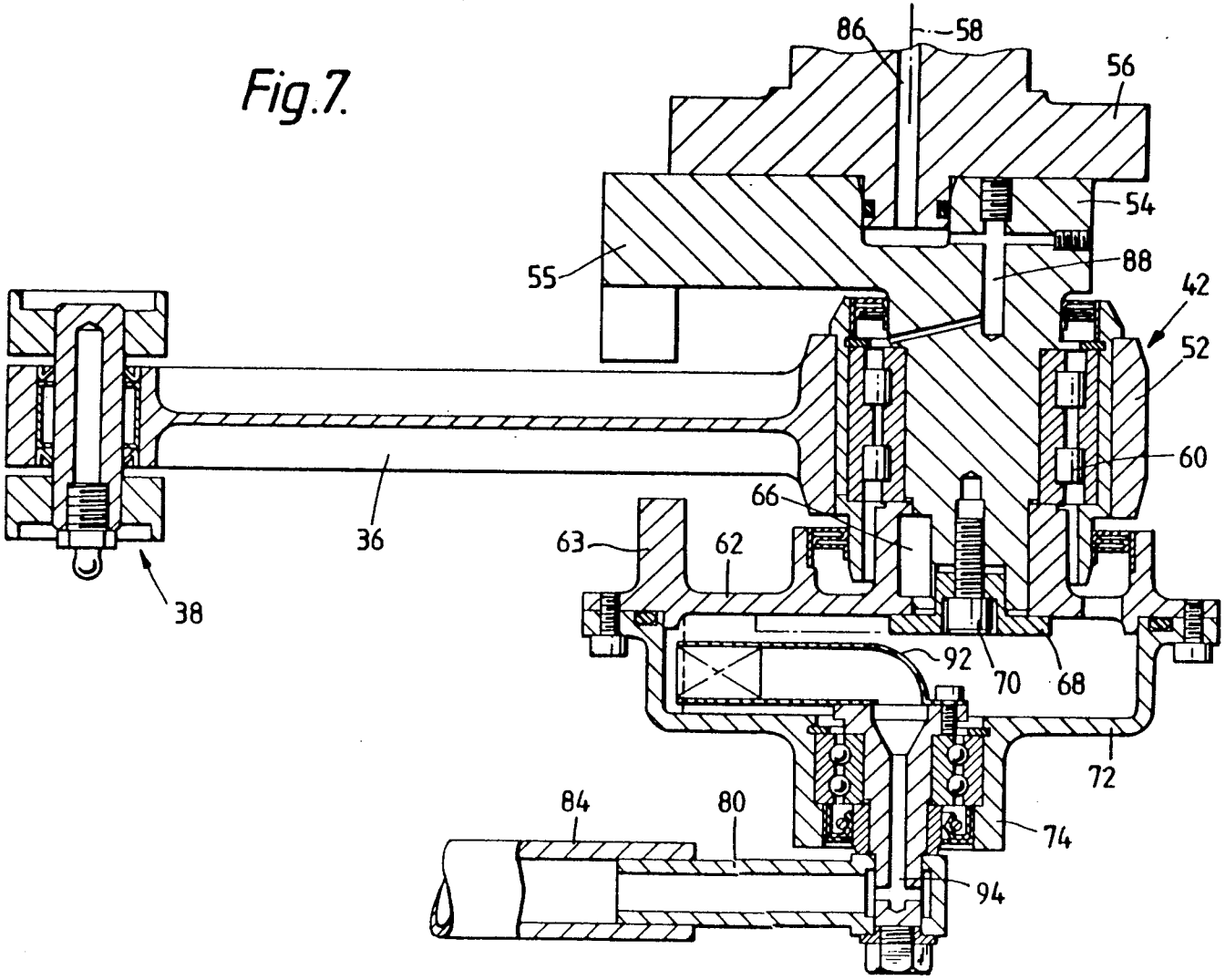
FIG. 7 is a sectional view of a modified bearing assembly suitable for use with the ledger assembly of FIG. 1.

A slightly modified bearing assembly is shown in FIGS. 7 and 8. Operation is similar to that of FIGS. 5 and 6 and similar reference numbers have been given for parts having similar functions. The differently-shaped collector tube 92 of FIGS. 7 and 8 is believed to be more efficient in collecting oil in the chamber 90 than that of FIGS. 5 and 6.

I claim:

1. A machine for producing rod-like articles, including a continuous rod cut-off device and a ledger assembly, said assembly comprising means for supporting a rod during cutting, a substantially rigid beam carrying the supporting means, drive means for reciprocating the beam, and resilient means supporting the beam for pivotal movement about an imaginary axis such that said supporting means follows an arcuate path relative to the imaginary axis, said resilient means comprising first means for permitting movement of the imaginary axis in a direction generally transverse to the rod during reciprocation of the beam and second means allowing movement of the imaginary axis in a direction generally transverse to said rod while resisting movement of said imaginary axis in a direction parallel to the rod, so that, during reciprocation of said beam caused by said drive means, said supporting means moves substantially parallel to the rod, and said transverse motion of said imaginary axis operates at least partly to compensate for transverse movement of said supporting means on said arcuate path, so that said supporting means follows a substantially straight path parallel to the rod.

2. A machine as claimed in claim 1, wherein said first means includes means arranged to allow reciprocal movement of an intermediate part of said beam.

3. A machine as claimed in claim 2, wherein said first means includes pivotal means.

4. A machine as claimed in claim 1, wherein said second means includes means arranged to allow reciprocal movement in said transverse direction.

5. A machine as claimed in claim 4, wherein said second means includes pivotal means.

6. A machine as claimed in claim 1, wherein the first means comprises means extending parallel to a longitudinal axis of the beam.

7. A machine as claimed in claim 6, wherein said first means comprises at least one leaf spring.

8. A machine as claimed in claim 1, wherein the second means comprises means extending in a direction transverse to a longitudinal axis of said beam.

9. A machine as claimed in claim 8, wherein said second means comprises at least one leaf spring.

10. A machine as claimed in claim 1, wherein the beam is connected to said first and second means respectively at locations which are spaced longitudinally on the beam.

11. A machine as claimed in claim 10, wherein said first and second means include means respectively constraining said locations to follow different arcuate paths as said beam is reciprocated by said drive means.

12. A machine as claimed in claim 1, wherein said supporting means is carried at or adjacent one end of the beam and the second means is connected at or adjacent the other end of the beam.

13. A machine as claimed in claim 12, wherein the second means is arranged substantially to prevent movement of said other end of the beam in a direction parallel to longitudinal movement of a rod passing said supporting means.

14. A machine as claimed in claim 1, wherein the first means extends from a stationary mounting to a connection to said beam in a direction generally away from said supporting means.

15. A machine for producing rod-like articles according to claim 1, said drive means including a bearing, means defining a supply path for lubricant under pressure to said bearing and means defining a return path for said lubricant, said return path defining means including a housing for receiving lubricant which has passed through the bearing and collection means which is movable relative to lubricant in the housing so that said lubricant is urged along a further portion of said return path connected to said collection means.

16. A machine as claimed in claim 15, wherein said housing is rotatable with a movable part of said bearing and said collection means is stationary.

17. A machine as claimed in claim 16, wherein the housing comprises a chamber having a generally cylindrical portion and the collection means comprises means arranged adjacent the internal periphery of said portion, so that lubricant moved to the periphery of said portion by action of centrifugal force is collected by said means and urged along said return path.

18. A machine as claimed in claim 15, wherein the supply path and the return path are on opposite sides of the bearing.

19. A machine as claimed in claim 15, wherein the housing is at least partly supported for rotation by further bearings carried by or connected to the collection means.

20. A machine for producing rod-like articles including a continuous rod cut-off device and a ledger assembly, said assembly comprising means for supporting a rod during cutting, a substantially rigid beam carrying the supporting means at one end thereof, drive means for reciprocating the beam, first mounting means connected to a position intermediate the length of the beam for allowing movement of the beam so that the rod supporting means is movable in a direction parallel to the rod, and second mounting means connected to the other end of the beam for allowing movement of the beam so that the rod supporting means is movable in a direction transverse to the rod, whereby said rod supporting means is constrained to follow a substantially straight path while at least partially surrounding the rod during reciprocation of said beam by said drive means, and wherein said drive means includes means for causing movement of said beam about a pivotal axis defined by said second mounting means, and said first mounting means comprises means for constraining said pivotal axis to move in a direction transverse to a longitudinal path of a rod passing said supporting means to compensate for transverse movement of the supporting means during pivotal movement about the pivotal axis.

21. A machine as claimed in claim 20, wherein said first mounting means comprises pivotal means.

22. A machine for producing rod-like articles, including a continuous rod cut-off device and a ledger assembly, said assembly comprising means for supporting a rod during cutting, a substantially rigid beam carrying the supporting means at one end thereof, drive means for reciprocating the beam, and mounting means connected to said beam adjacent the other end thereof for supporting said beam while allowing pivotal movement of the beam, and a pivotal linkage connected to said beam and extending substantially parallel to the beam from the connection point therewith to a stationary support intermediate said ends of the beam in a direction away from said other end and towards said one end of the beam.

23. A machine for producing rod-like articles, including a continuous rod cut-off device and a ledger assembly said ledger assembly comprising means for supporting a rod moving axially along a path; a substantially rigid beam carrying said supporting means; mounting means for supporting said beam for pivotal movement about an imaginary axis, during which pivotal movement said supporting means follows an arcuate path relative to said imaginary axis resulting in arcuate movement of said supporting means relative to the path of said rod; drive means for reciprocating the beam through a predetermined stroke; and compensating means for constraining said imaginary axis to move in a direction generally transverse to the rod during reciprocation of the beam by an amount which compensates the arcuate movement of said supporting means caused by said pivotal movement of said beam, so that said supporting means follows a substantially straight path parallel to the path of said rod.

24. A machine as claimed in claim 23, wherein said mounting means includes first means pivotally coupled to said beam for resiliently supporting said beam for movement in a direction generally transverse to the rod, and said compensating means includes second means responsive to reciprocation of the beam by said drive means for deflecting said beam in said direction toward said rod by an amount related to said predetermined stroke.

25. A machine as claimed in claim 24, wherein said second means comprises a pivotal linkage extending substantially parallel to the beam from a connection point with the beam to a stationary support intermediate the ends of the beam in a direction toward said rod.

26. A machine for producing rod-like articles, including a continuous rod cut-off device and a ledger assembly, said ledger assembly comprising means for supporting a rod during cutting; a substantially rigid beam carrying said supporting means at one end thereof; a first leaf spring pivotally coupled to the other end of said beam and mounted on a fixed support so as to permit pivotal movement of said beam about an imaginary axis passing through said other end thereof and movement in a direction generally transverse to said rod; a second leaf spring connected between a connection point on said beam adjacent said other end thereof and a fixed support intermediate the ends of said beam and extending substantially in parallel to the beam from said connection point toward said one end of said beam; and drive means for reciprocating the beam.

* * * * *